US011295682B2

(12) United States Patent
Kang

(10) Patent No.: US 11,295,682 B2
(45) Date of Patent: Apr. 5, 2022

(54) DRIVING METHOD FOR LIQUID CRYSTAL DISPLAY DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/041,322

(22) PCT Filed: Nov. 15, 2018

(86) PCT No.: PCT/CN2018/115533
§ 371 (c)(1),
(2) Date: Sep. 24, 2020

(87) PCT Pub. No.: WO2019/184388
PCT Pub. Date: Oct. 3, 2019

(65) Prior Publication Data

US 2021/0020128 A1 Jan. 21, 2021

(30) Foreign Application Priority Data

Mar. 30, 2018 (CN) ..... 201810292240.1

(51) Int. Cl.
*G09G 3/36* (2006.01)
*G09G 3/34* (2006.01)

(52) U.S. Cl.
CPC ..... *G09G 3/3607* (2013.01); *G09G 3/3413* (2013.01); *G09G 3/3426* (2013.01);
(Continued)

(58) Field of Classification Search
CPC ... G09G 2300/0452; G09G 2310/0264; G09G 2320/0242; G09G 2320/0252;
(Continued)

(56) References Cited

U.S. PATENT DOCUMENTS

2006/0262078 A1* 11/2006 Inuzuka ..... G09G 3/3413 345/102
2016/0148579 A1* 5/2016 Kimura ..... G09G 3/3607 345/694
(Continued)

FOREIGN PATENT DOCUMENTS

CN 101197917 A 6/2008
CN 101316370 A 12/2008
(Continued)

OTHER PUBLICATIONS

International Search Report for International Application No. PCT/CN2018/115533 dated Feb. 22, 2019.

*Primary Examiner* — Kenneth Bukowski

(57) ABSTRACT

This application relates to a driving method for a display device. Turn-on/turn off of a color light source corresponding to a minimum average value in a time period of displaying a second gray-scale data group is controlled according to the determining of whether a color saturation value C falls within a specified range of a color saturation value of a display area.

20 Claims, 4 Drawing Sheets

(52) U.S. Cl.
CPC ..... *G09G 2300/0452* (2013.01); *G09G 2310/0264* (2013.01); *G09G 2320/0242* (2013.01); *G09G 2320/0252* (2013.01); *G09G 2320/064* (2013.01); *G09G 2320/0666* (2013.01); *G09G 2340/06* (2013.01); *G09G 2360/16* (2013.01)

(58) Field of Classification Search
CPC ..... G09G 2320/0626; G09G 2320/064; G09G 2320/0666; G09G 2340/0435; G09G 2340/06; G09G 2360/16; G09G 3/3413; G09G 3/3426; G09G 3/3607
See application file for complete search history.

(56) References Cited

U.S. PATENT DOCUMENTS

| | | | | |
|---|---|---|---|---|
| 2020/0013351 | A1* | 1/2020 | Shan | G09G 3/3607 |
| 2020/0020286 | A1* | 1/2020 | Shan | G09G 3/3607 |
| 2020/0226987 | A1* | 7/2020 | Shan | G09G 3/3607 |
| 2021/0174762 | A1* | 6/2021 | Sun | G09G 3/20 |

FOREIGN PATENT DOCUMENTS

| | | | |
|---|---|---|---|
| CN | 108364620 | A | 8/2018 |
| JP | 2001189871 | A | 7/2001 |

* cited by examiner

DRIVING METHOD FOR LIQUID CRYSTAL DISPLAY DEVICE

TECHNICAL FIELD

This application relates to the field of liquid crystal display technologies, and in particular, to a driving method for a liquid crystal display device.

BACKGROUND

The statement herein merely provides background information related to this application, and does not necessarily form the prior art.

In large-viewing angle and front-viewing angle color shifts of various representative color systems of liquid crystal displays, large-viewing angle color shifts of color systems of red, green, and blue are severer than those of other color systems. In addition, because a viewing-angle brightness proportion of gray-scale liquid crystal display is rapidly saturated and increased, a difference between front-viewing angle brightness and side-viewing angle brightness of a lower gray-scale value is greater.

Currently, a manner for alleviating a color shift is subdividing each sub-pixel into a primary pixel and a secondary pixel, and then, the primary pixel is driven by a relatively high driving voltage, and the secondary pixel is driven by a relatively low driving voltage. The primary pixel and secondary pixel display a sub-pixel together. In addition, when the primary pixel and the secondary pixel are respectively driven by using the relatively high driving voltage and the relatively low driving voltage, a relationship between brightness and a corresponding gray scale at a front viewing angle can be maintained unchanged. In this method, usually, in a first half of a gray scale, the primary pixel is driven and displayed by using a relatively high driving voltage, and the secondary pixel is not displayed. Brightness of the entire sub-pixel is a half of brightness of the primary pixel. In a last half of the gray scale, the primary pixel is driven and displayed by using a relatively high driving voltage, and the secondary pixel is driven and displayed by using a relatively low driving voltage. Brightness of the entire sub-pixel is a half of a sum of brightness of the primary pixel and brightness of the secondary pixel. After such synthesis, although a color shift situation at a large viewing angle is alleviated, quantities of metal wires and driving devices need to be doubled to drive secondary pixels, affecting transmittance and an aperture ratio of a panel and consequently, increasing production costs.

SUMMARY

Based on this, this application provides a driving method for a liquid crystal display device, to alleviate a large-viewing angle color shift, and meanwhile, ensure that costs are not increased.

This application provides a driving method for a liquid crystal display device, wherein the liquid crystal display device comprises a display module, a driving circuit, a backlight module; the display module comprises a plurality of pixel units arranged in an array, the pixel unit comprises a red sub-pixel, a green sub-pixel, and a blue sub-pixel; the pixel unit generates one color each time when receiving one gray-scale value group; the gray-scale value group is generated from gray-scale data input into the display device; the gray-scale value group comprises a red gray-scale value, a green gray-scale value, and a blue gray-scale value; the color generated by the pixel unit each time is any one type of a unitary color, a binary mixed color, and a trinary mixed color; and the display module is divided into at least two mutually independent display areas, wherein the driving method comprises:

calculating an average value of the red gray-scale values, an average value of the green gray-scale values, and an average value of the blue gray-scale values in the $N^{th}$ display area;

determining a minimum average value among the average value of the red gray-scale values, the average value of the green gray-scale values, and the average value of the blue gray-scale values in the $N^{th}$ display area;

calculating a color saturation value C and a hue angle value H in an LCH color space diagram according to the average value of the red gray-scale values, the average value of the green gray-scale values, and the average value of the blue gray-scale values in the $N^{th}$ display area; and determining, according to a range of the hue angle value H of the $N^{th}$ display area, whether the color saturation value C falls within a specified range of a color saturation value of the display area, and if yes, setting a gray-scale value corresponding to the minimum average value in the display area to 0 in a time period of displaying the second gray-scale data group; otherwise, maintaining a gray-scale value corresponding to the minimum average value in the display area unchanged in a time period of displaying the second gray-scale data group, wherein N is an integer greater than or equal to 1;

the color saturation value C ranges from 0 to 100; and the hue angle value H ranges from 0° to 360°.

Based on the same inventive concept, this application further provides another driving method for a liquid crystal display device, wherein the liquid crystal display device comprises a display module, a driving circuit, a backlight module; the display module comprises a plurality of pixel units arranged in an array, the pixel unit comprises a red sub-pixel, a green sub-pixel, and a blue sub-pixel; the pixel unit generates one color each time when receiving one gray-scale value group; the gray-scale value group is generated from gray-scale data input into the display device; the gray-scale value group comprises a red gray-scale value, a green gray-scale value, and a blue gray-scale value; the color generated by the pixel unit each time is any one type of a unitary color, a binary mixed color, and a trinary mixed color; a plurality of backlight units is disposed in the backlight module; the backlight unit comprises a red light source, a green light source, and a blue light source; the display module is divided into at least two mutually independent display areas; and the display area corresponds to at least one backlight unit, and the backlight units corresponding to the different display areas are mutually independent, wherein the driving method comprises:

calculating an average value of the red gray-scale values, an average value of the green gray-scale values, and an average value of the blue gray-scale values in the $N^{th}$ display area;

determining a minimum average value among the average value of the red gray-scale values, the average value of the green gray-scale values, and the average value of the blue gray-scale values in the $N^{th}$ display area;

calculating a color saturation value C and a hue angle value H in an LCH color space diagram according to the average value of the red gray-scale values, the average value of the green gray-scale values, and the average value of the blue gray-scale values in the $N^{th}$ display area; and determining, according to a range of the hue angle value H of the $N^{th}$ display area, whether the color saturation value C falls within a specified range of a color saturation value of the display area, and if yes, turning off a corresponding color light source in the backlight unit corresponding to the minimum average value in the display area in a time period of displaying the second gray-scale data group, or setting a gray-scale value corresponding to the minimum average value in the display area to 0 in a time period of displaying the second gray-scale data group; otherwise, maintaining a corresponding color light source in the backlight unit corresponding to the minimum average value in the display area on in a time period of displaying the second gray-scale data group, and maintaining a gray-scale value corresponding to the minimum average value in the display area unchanged in a time period of displaying the second gray-scale data group, wherein:

N is an integer greater than or equal to 1;

the color saturation value C ranges from 0 to 100; and the hue angle value H ranges from 0° to 360°.

According to the driving method for a liquid crystal display device, the average value of the red gray-scale values, the average value of the green gray-scale values, and the average value of the blue gray-scale values in the $N^{th}$ display area are calculated, and the minimum average value among the average value of the red gray-scale values, the average value of the green gray-scale values, and the average value of the blue gray-scale values in the $N^{th}$ display area is determined. In addition, the color saturation value C and the hue angle value H in the LCH color space diagram are calculated according to the average value of the red gray-scale values, the average value of the green gray-scale values, and the average value of the blue gray-scale values in the $N^{th}$ display area. Further, whether the color saturation value C falls within the specified range of the color saturation value of the display area is determined according to the range of the hue angle value H of the $N^{th}$ display area, and whether the light source of the color corresponding to the minimum average value in the display area is turned off in the time period of displaying the second gray-scale data group and whether the gray-scale value corresponding to the minimum average value in the display area is 0 are determined. In this way, a brightness proportion of a dominant hue is increased, so that a color shift situation of a large-viewing angle dominant hue affected by a low-voltage sub-pixel is alleviated. Moreover, not only brightness presentation of a main signal at a large viewing angle is enhanced, but also entire picture quality and displayed brightness can be maintained unchanged by increasing backlight brightness to two times original brightness, and the entire picture quality and displayed brightness can be maintained unchanged by increasing a driving frequency to two times an original driving frequency. In addition, energy can be saved while alleviating a color shift, and additional wiring on a liquid crystal display panel is not needed while guaranteeing color authenticity of graphics and text.

DETAILED DESCRIPTION OF THE EMBODIMENTS

To make the objectives, technical solutions, and advantages of this application clearer and more comprehensible, the following further describes this application in detail with reference to the accompanying drawings and embodiments. It should be understood that the specific embodiments described herein are merely used to explain this application but are not intended to limit this application.

Figure 1:
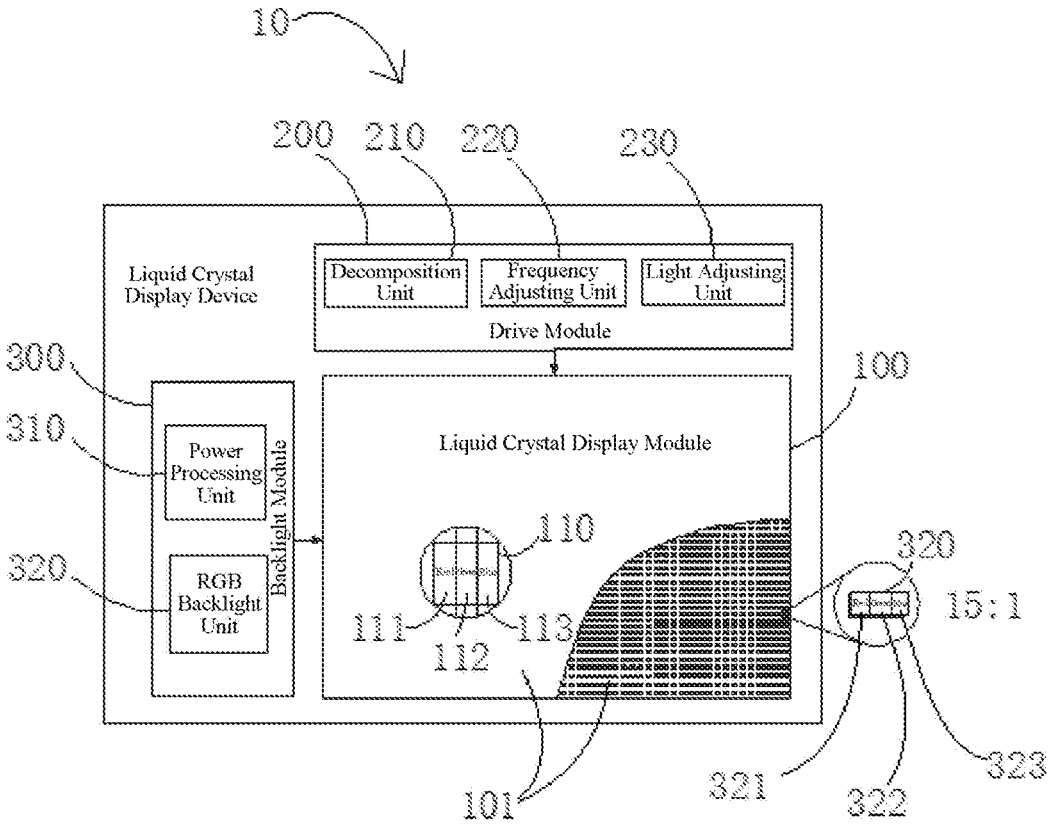
FIG. 1 is a schematic structural diagram of a liquid crystal display device.
Figure 2:
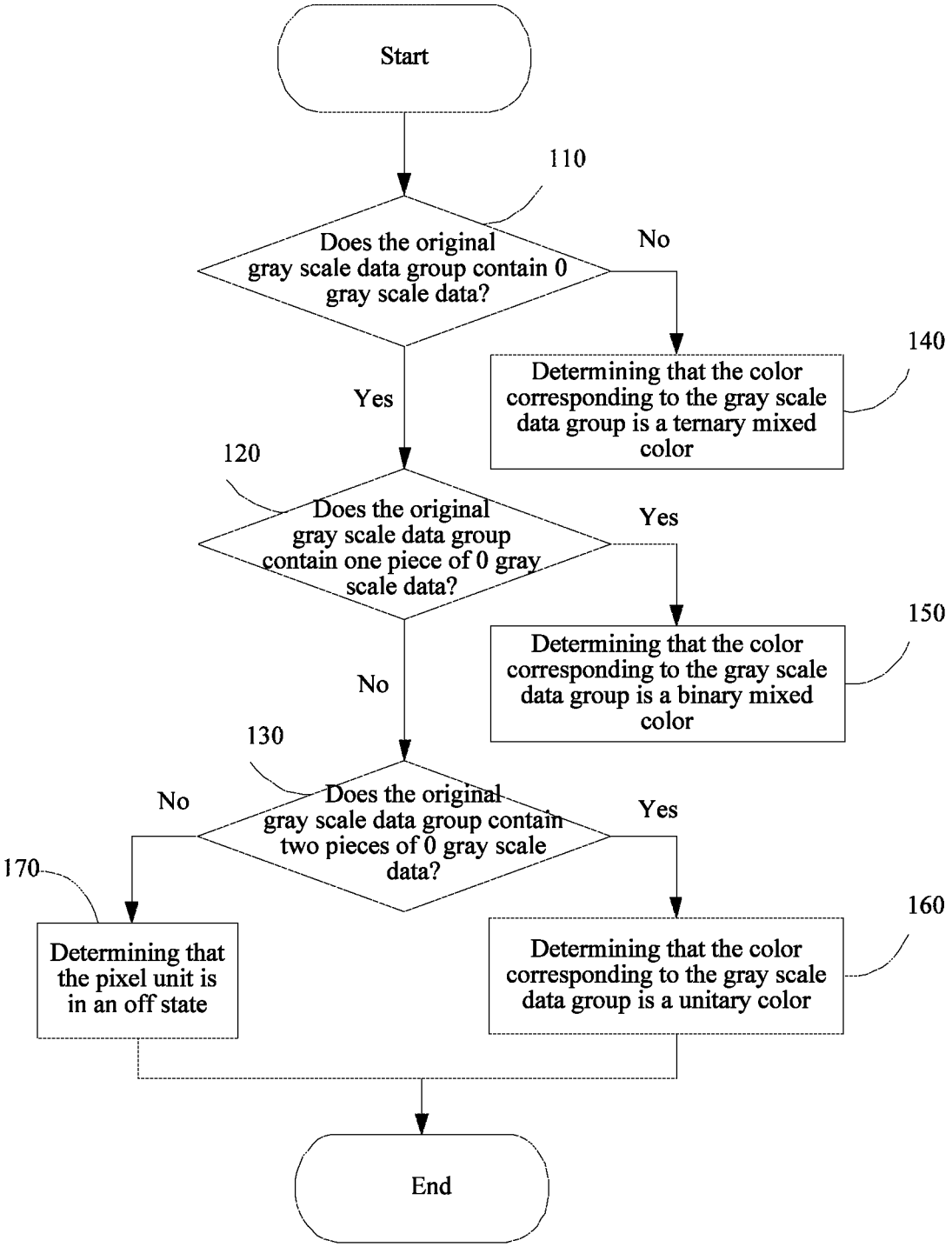
FIG. 2 is a flowchart of a driving method for determining a type of a displayed color of a pixel unit corresponding to an original gray-scale data group.

This application provides a driving method for a liquid crystal display device. As shown in FIG. 1, the liquid crystal display device includes a display module 100, a driving circuit 200, and a backlight module 300. The display module 100 includes a plurality of pixel units arranged in an array 110, and the pixel unit 110 includes a red sub-pixel 111, a green sub-pixel 112, and a blue sub-pixel 113. Each time the pixel unit 110 receives a gray-scale value group, the pixel unit 110 generates a color. The gray-scale value group is generated from gray-scale data input into the display device. The gray-scale value group includes a red gray-scale value, a green gray-scale value, and a blue gray-scale value. The color generated by the pixel unit each time is any one type of a unitary color, a binary mixed color, and a trinary mixed color. The backlight module 300 includes a power supply processing unit 310 and a backlight unit 320. The display module 100 is configured to display graphic and text information. The driving circuit 200 is configured to receive, process, and output driving data to control the display module to work normally. The backlight module 300 is configured to process a current and light up the backlight unit 320. The driving circuit 200 includes a gray-scale data decomposition unit 210, a driving frequency adjustment unit 220, and a backlight adjustment unit 230. The gray-scale data decomposition unit 210 is configured to decompose gray-scale data and output a gray-scale value signal. The driving frequency adjustment unit 220 is configured to adjust a driving frequency. The backlight adjustment unit 230 is configured to adjust a color and brightness of a light source of the backlight unit. The display module 100 is divided into at least two mutually independent display areas. The driving method includes:

calculating an average value of the red gray-scale values, an average value of the green gray-scale values, and an average value of the blue gray-scale values in the $N^{th}$ display area;

determining a minimum average value among the average value of the red gray-scale values, the average value of the green gray-scale values, and the average value of the blue gray-scale values in the $N^{th}$ display area;

calculating a color saturation value C and a hue angle value H in an LCH color space diagram according to the average value of the red gray-scale values, the average value of the green gray-scale values, and the average value of the blue gray-scale values in the $N^{th}$ display area; and determining, according to a range of the hue angle value H of the $N^{th}$ display area, whether the color saturation value C falls within a specified range of a color saturation value of the display area, and if yes, setting a gray-scale value corresponding to the minimum average value in the display area to 0 in a time period of displaying a second gray-scale data group; otherwise, maintaining a gray-scale value corresponding to the minimum average value in the display area unchanged in a time period of displaying a second gray-scale data group.

N is an integer greater than or equal to 1.

The color saturation value C ranges from 0 to 100.

The hue angle value H ranges from 0° to 360°.

In an embodiment, the driving method further includes:

determining a type of a color corresponding to a to-be-displayed original gray-scale data group of the $n^{th}$ pixel unit 110;

dividing, according to the type of the color corresponding to the to-be-displayed original gray-scale data group of the $n^{th}$ pixel unit 110, the original gray-scale data group into a first gray-scale data group and a second gray-scale data group in accordance with a specified grouping rule; and outputting and displaying the first gray-scale data group and the second gray-scale data group respectively in two consecutive time periods.

n is an integer greater than or equal to 1.

In an embodiment, the type of the color corresponding to the original gray-scale data is determined according to a quantity of pieces of 0-gray-scale data in the to-be-displayed original gray-scale data group of the $n^{th}$ pixel unit.

The color corresponding to the original gray-scale data group is a trinary mixed color when the original gray-scale data group does not include 0-gray-scale data.

The color corresponding to the original gray-scale data group is a binary mixed color when the original gray-scale data group includes one piece of 0-gray-scale data.

The color corresponding to the original gray-scale data group is a unitary mixed color when the original gray-scale data group includes two pieces of 0-gray-scale data.

Figure 3:
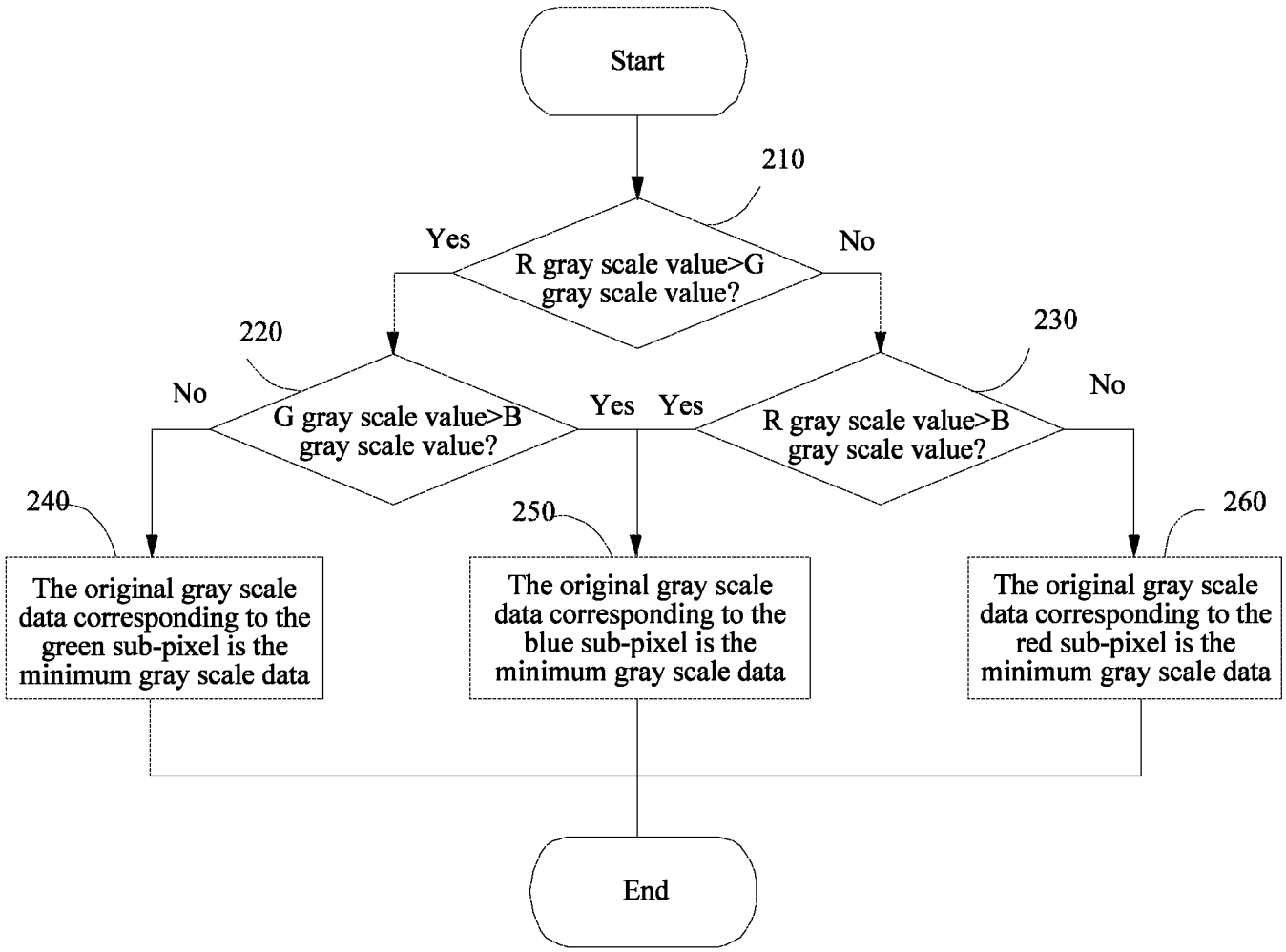
FIG. 3 is a flowchart of a driving method for determining minimum gray-scale data in a gray-scale data group of a trinary mixed color.

Specifically, as shown in FIG. 3, a method of an embodiment of determining the type of the color corresponding to the to-be-displayed original gray-scale data group of the $n^{th}$ pixel unit 110 includes steps S110 to S170.

Step S110: Determine whether the to-be-displayed original gray-scale data group of the $n^{th}$ pixel unit includes 0-gray-scale data, and if not, perform step S140; otherwise, perform step S120. If a color is of a trinary mixed color type, it indicates that the color includes colors of three components, namely, red, green, and blue, and in the field of liquid crystal display technologies, none of gray-scale values of a red sub-pixel, a green sub-pixel, and a blue sub-pixel in a corresponding pixel unit is 0, that is, a corresponding original gray-scale data group does not include 0-gray-scale data. Therefore, whether the original gray-scale data group is a gray-scale data group of a trinary mixed color can be determined by determining whether the original gray-scale data group includes 0-gray-scale data.

Step S120: Determine whether the to-be-displayed original gray-scale data group of the $n^{th}$ pixel unit includes only one piece of 0-gray-scale data, and if yes, perform step S150; otherwise, perform step S130. If a color is of a binary mixed color type, it indicates that the color includes any two colors of three components, namely, red, green, and blue, and in the field of liquid crystal display technologies, only one of gray-scale values of a red sub-pixel, a green sub-pixel, and a blue sub-pixel in a corresponding pixel unit is 0, and the other two are not 0, that is, a corresponding original gray-scale data group includes only one piece of 0-gray-scale data. Therefore, whether the original gray-scale data group is a gray-scale data group of a binary mixed color can be determined by determining whether the original gray-scale data group includes only one piece of 0-gray-scale data.

Step S130: Determine whether the to-be-displayed original gray-scale data group of the $n^{th}$ pixel unit includes only two pieces of 0-gray-scale data, and if yes, perform step S160; otherwise, perform step S170. If a color is of a unitary color type, it indicates that the color includes any one color of three components, namely, red, green, and blue, and in the field of liquid crystal display technologies, only two of gray-scale values of a red sub-pixel, a green sub-pixel, and a blue sub-pixel in a corresponding pixel unit are 0, and the other one is not 0, that is, a corresponding original gray-scale data group includes only two pieces of 0-gray-scale data. Therefore, whether the original gray-scale data group is a unitary color gray-scale data group can be determined by determining whether the original gray-scale data group includes only two pieces of 0-gray-scale data.

Step S140: Determine that a color displayed by a pixel unit corresponding to the gray-scale data group is a trinary mixed color.

Step S150: Determine that a color displayed by a pixel unit corresponding to the gray-scale data group is a binary mixed color.

Step S160: Determine that a color displayed by a pixel unit corresponding to the gray-scale data group is a unitary color.

Step S170: Determined that a pixel unit corresponding to the gray-scale data group is in an off state. When all of gray-scale values of respective sub-pixels of a pixel unit are 0, it indicates the pixel unit does not take on a display task. In this case, voltages of respective sub-pixels of the pixel unit are 0, and the pixel unit is in an off state. Because light rays cannot transmit through liquid crystals, the pixel unit is black.

In some embodiments, the grouping rule specifically includes the following:

Minimum original gray-scale data in the original gray-scale data group corresponding to a trinary mixed color pixel unit 110 is used as common gray-scale data of the red sub-pixel 111, the green sub-pixel 112, and the blue sub-pixel 113 in the pixel unit, to form the first gray-scale data group.

Minimum non-0-gray-scale data in a difference data group obtained by subtracting the first gray-scale data group from the original gray-scale data group corresponding to the trinary mixed color pixel unit 110 is used as common gray-scale data of sub-pixels corresponding to pieces of non-0-gray-scale data in the difference data group, to form, together with 0-gray-scale data, the second gray-scale data group.

A difference data group obtained by subtracting the first gray-scale data group and the second gray-scale data group separately from the original gray-scale data group corresponding to the trinary mixed color pixel unit 110 is used as a third gray-scale data group.

Minimum non-0-gray-scale data in the original gray-scale data group corresponding to a binary mixed color pixel unit 110 is used as common gray-scale data of sub-pixels corresponding to two pieces of non-0-gray-scale data in the pixel unit 110, to form, together with 0-gray-scale data, the first gray-scale data group. Moreover, a difference data group obtained by subtracting the first gray-scale data group from the original gray-scale data group is used as the second gray-scale data group of the pixel unit 110.

Pieces of gray-scale data corresponding to halves of a gray-scale value corresponding to non-0-gray-scale data in the original gray-scale data group corresponding to a unitary color pixel unit 110 are used as pieces of gray-scale data of a sub-pixel corresponding to non-0-gray-scale data in the pixel unit 110, to form, together with 0-gray-scale data, the first gray-scale data group and the second gray-scale data group respectively.

Figure 4:
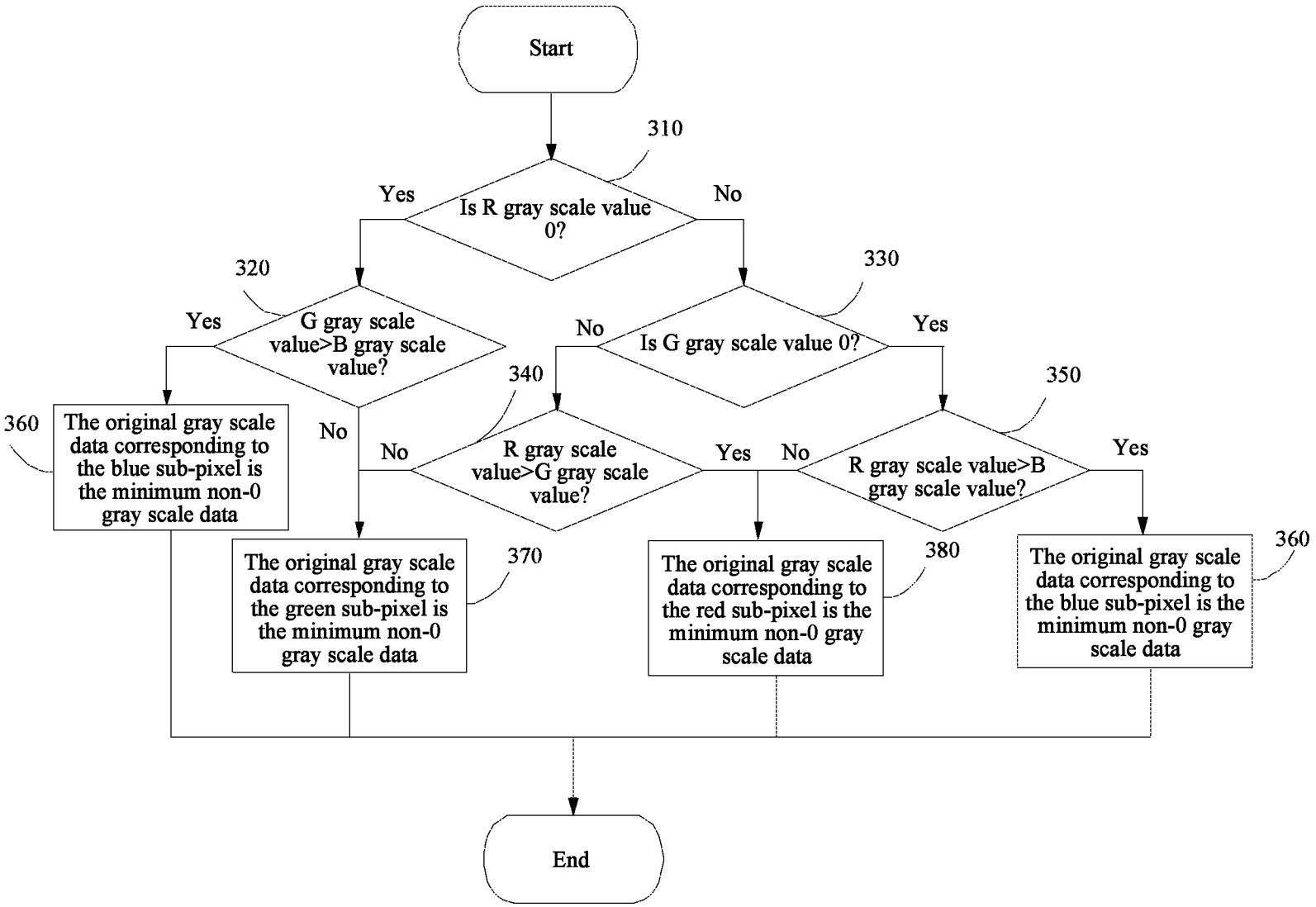
FIG. 4 is a flowchart of a driving method for determining minimum non-0-gray-scale data in a gray-scale data group of a binary mixed color.

An embodiment shown in FIG. 4 is a method for determining minimum gray-scale data in a gray-scale data group of a trinary mixed color, specifically including steps S210 to S260.

Step S210: Determine whether a red gray-scale value in an original gray-scale value group corresponding to a to-be-displayed original gray-scale data group of a trinary mixed color pixel unit is greater than a green gray-scale value, and if yes, perform step S220; otherwise, perform step S230. The step S210 includes first determining a relationship of magnitude between a gray-scale value corresponding to the red sub-pixel 111 and a gray-scale value corresponding to the green sub-pixel 112. One case is exemplified merely for ease of description. Actually, gray-scale values of any two colors in the red, green, and blue sub-pixels can be used for performing determining first.

Step S220: Determine whether the green gray-scale value in the original gray-scale value group is greater than a blue gray-scale value, and if yes, perform step S250; otherwise, perform step S240. The step S220 includes comparing a less gray-scale value in step S120 with a gray-scale value of another color, performing determining, and outputting a corresponding determining result and a corresponding action signal.

Step S230: Determine whether the red gray-scale value in the original gray-scale value group is greater than a blue gray-scale value, and if yes, perform step S250; otherwise, perform step S260. The step S230 includes comparing a less gray-scale value in step S120 with a gray-scale value of another color, performing determining, and outputting a corresponding determining result and a corresponding action signal.

Step S240: Determine gray-scale data corresponding to a green sub-pixel in the original gray-scale data group is minimum original gray-scale data.

Step S250: Determine gray-scale data corresponding to a blue sub-pixel in the original gray-scale data group is minimum original gray-scale data.

Step S260: Determine gray-scale data corresponding to a red sub-pixel in the original gray-scale data group is minimum original gray-scale data.

In an embodiment, an embodiment shown in FIG. 5 is a method for determining minimum non-0-gray-scale data in a gray-scale data group of a binary mixed color, specifically including steps S310 to S380.

Step S310: Determine whether a red gray-scale value in an original gray-scale value group corresponding to a to-be-displayed original gray-scale data group of a binary mixed color pixel unit is 0, and if yes, perform step S320; otherwise, perform step S330.

If a color is of a binary mixed color type, it indicates that the color includes any two colors of three components, namely, red, green, and blue. In the field of liquid crystal display technologies, only one of gray-scale values of a red sub-pixel, a green sub-pixel, and a blue sub-pixel in a corresponding pixel unit is 0, and the other two are not 0, that is, a corresponding original gray-scale data group includes only one piece of 0-gray-scale data. The step S310 includes first determining whether a gray-scale value corresponding to the red sub-pixel 111 is 0. One case is exemplified merely for ease of description. Actually, gray-scale values of any one color in the red, green, and blue sub-pixels can be used for performing determining first.

Step S320: Determine whether a green gray-scale value corresponding to the pixel unit in which the gray-scale value of the red sub-pixel is 0 is greater than a blue gray-scale value, and if yes, perform step S360; otherwise, perform step S370. In the step S320, when it is determined that the gray-scale value corresponding to the red sub-pixel 111 is 0, it is determined that the color displayed by the pixel unit is a mixed color of green and blue. Therefore, minimum non-0-gray-scale data in the original gray-scale data group corresponding to the pixel unit can be determined by determining a relationship of magnitude between the green gray-scale value and the blue gray-scale value.

Step S330: Determine whether a green gray-scale value corresponding to the pixel unit in which the gray-scale value of the red sub-pixel is not 0 is 0, and if yes, perform step S350; otherwise, perform step S340. The step S330 includes: when determining that the gray-scale value corresponding to the red sub-pixel 111 is not 0, further determining whether the gray-scale value corresponding to the green sub-pixel 112 is 0. One case is exemplified merely for ease of description. Actually, a gray-scale value of a blue sub-pixel can alternatively be used for performing determining.

Step S340: Determine whether the red gray-scale value corresponding to the pixel unit in which the gray-scale value of the blue sub-pixel is 0 is greater than the green gray-scale value, and if yes, perform step S380; otherwise, perform step S370. In the step S340, when it is determined that the gray-scale value corresponding to the blue sub-pixel 113 is 0, it is determined that the color displayed by the pixel unit is a mixed color of green and red. Therefore, minimum non-0-gray-scale data in the original gray-scale data group corresponding to the pixel unit can be determined by determining a relationship of magnitude between the green gray-scale value and the red gray-scale value.

Step S350: Determine whether the red gray-scale value corresponding to the pixel unit in which the gray-scale value of the green sub-pixel is 0 is greater than the blue gray-scale value, and if yes, perform step S360; otherwise, perform step S380. In the step S350, when it is determined that the gray-scale value corresponding to the green sub-pixel 112 is 0, it is determined that the color displayed by the pixel unit is a mixed color of red and blue. Therefore, minimum non-0-gray-scale data in the original gray-scale data group corresponding to the pixel unit can be determined by determining a relationship of magnitude between the red gray-scale value and the blue gray-scale value.

Step S360: Determine that original gray-scale data corresponding to the blue sub-pixel in the original gray-scale data group corresponding to the binary mixed color pixel unit is minimum non-0-gray-scale data.

Step S370: Determine that original gray-scale data corresponding to the green sub-pixel in the original gray-scale data group corresponding to the binary mixed color pixel unit is minimum non-0-gray-scale data.

Step S380: Determine that original gray-scale data corresponding to the red sub-pixel in the original gray-scale data group corresponding to the binary mixed color pixel unit is minimum non-0-gray-scale data.

In the grouping rule, because a viewing-angle brightness proportion of gray-scale liquid crystal display is rapidly saturated and increased, a difference between front-viewing angle brightness and side-viewing angle brightness of a lower gray-scale value is greater. Therefore, to emphasize a dominant color and alleviate a color shift, lowest gray-scale data in an original gray-scale data group is displayed in a separate group of gray-scale data, a color not including the lowest gray-scale data can be displayed in other groups, thereby eliminating impact on display of a dominant color from a lowest gray-scale color in the group because a viewing-angle brightness proportion of gray-scale liquid crystal display is rapidly saturated and increased. To describe the grouping rule more clearly and directly, a gray-scale value group is used for description on grouping below. It should be noted that a grouping process is data grouping performed when an original gray-scale data group is processed. A gray-scale value group is used herein for description merely for convenience and conciseness.

In the foregoing content, it is assumed that an original gray-scale data group corresponding to a pixel unit 110 is converted into an original gray-scale value group (A, B, C). To be specific, a gray-scale value corresponding to a red sub-pixel 111 is A, a gray-scale value corresponding to a green sub-pixel 112 is B, and a gray-scale value corresponding to a blue sub-pixel 113 is C. When A>B>C, it can be determined that the gray-scale value corresponding to the blue sub-pixel 113 is a minimum gray-scale value, that is, a lowest gray-scale value, among the gray-scale values, and a difference between front-viewing angle brightness and side-viewing angle brightness is greatest. To reduce impact of the lowest gray-scale value, the lowest gray-scale value is used as a common gray-scale value of the red sub-pixel 111, the green sub-pixel 112, and the blue sub-pixel 113, to form a first gray-scale value group, that is, (C, C, C). A difference group obtained by subtracting the lowest gray-scale value from gray-scale values corresponding to the red sub-pixel 111, the green sub-pixel 112, and the blue sub-pixel 113 in the original gray-scale data separately as a second gray-scale value group, that is, (A-C, B-C, 0). In this way, the lowest gray-scale value can be removed from the second gray-scale value group, and impact of the lowest gray-scale value on a color shift at a large viewing angle when the second gray-scale value group is displayed is alleviated, so that a proportion of a sum of decomposed dominant color gray-scale values to a low gray-scale value is increased. Therefore, not only a color shift at a side viewing angle is alleviated, but also brightness of a dominant color is increased.

In the foregoing content, both of the gray-scale value data group and the gray-scale value group use a pixel unit 110 as a smallest unit, and are data groups including gray-scale data or gray-scale values respectively corresponding to the red sub-pixel 111, the green sub-pixel 112, and the blue sub-pixel 113. The original gray-scale data group is an original gray-scale value data group that includes red, green, and blue gray-scale data and that is input into the display device. The original gray-scale value group is a gray-scale value group that is directly converted from the original gray-scale data group and that includes red, green, and blue gray-scale data.

An objective of decomposing original gray-scale data groups corresponding to a binary mixed color and a unitary color into two groups of gray-scale data groups is to synchronize with a control execution manner of a gray-scale data group of a trinary mixed color to facilitate driving and control.

In some embodiments, a specific method for determining whether a color light source corresponding to a minimum average value in the display area is turned off in a time period of displaying the second gray-scale data group includes the following:

Coordinates are established in an LCH color space diagram. The hue angle value H corresponding to red is 0°, the hue angle value H corresponding to yellow is 90°, the hue angle value H corresponding to green is 180°, and the hue angle value H corresponding to blue is 270°.

The LCH color space diagram is divided into a plurality of hue angle ranges. Each hue angle range corresponds to a dominant hue area.

A preset value range of the color saturation value C is set in each hue angle range.

A hue angle range of the hue angle value H is determined, and whether the color saturation value C falls within the preset value range corresponding to the hue angle range is determined. If yes, the color light source corresponding to the minimum average value in the display area is turned off in a time period of displaying the second gray-scale data group. Otherwise, the color light source corresponding to the minimum average value in the display area is maintained on in a time period of displaying the second gray-scale data group. If the LCH color space diagram is divided into more hue angle ranges, color areas are denser, and its precision of controlling color authenticity of the display area is higher.

To describe solutions of the foregoing embodiment more clearly and comprehensibly, the LCH color space diagram is equally divided into 6 hue angle ranges for specific description.

It should be noted that to express the present disclosed solution more clearly and vividly, a display module having i*j (where i and j are both positive integers) pixels is divided into n*m (where n and m are both positive integers) mutually independent display areas. The LCH color space diagram is equally divided into 6 hue angle ranges, and a method of a specific embodiment of actual operation is described in more detail. It should be understood that the description of the part merely helps understanding this application, and should not be interpreted as a protection scope of this disclosure for any reason.

In the following embodiments, for convenient expression, in each pixel unit of a display module, a red sub-pixel is expressed as R(i, j), a green sub-pixel is expressed as G(i, j), and a blue sub-pixel is expressed as B(i, j). In the $(n*m)^{th}$ display area, an average value of red gray-scale values is expressed as Ave_R(n, m)=A, an average value of green gray-scale values is expressed as Ave_G(n, m)=B, and an average value of blue gray-scale value is expressed as Ave_B(n, m)=C. A hue angle value H is expressed as H(n, m). A color saturation value C is expressed as C(n, m). A preset value range of the color saturation value C in the $n^{th}$ hue angle range is expressed as CTLn to CTHn (where n is an integer ranging from 1 to 6).

In some embodiments, when in a display area (n, m), a hue angle value H(n, m) calculated according to average value signals Ave_R(n, m)=A, Ave_G(n, m)=B, and Ave_B (n, m)=C falls within a hue angle range of 330 to 30, a color saturation value C(n, m) falls within a preset value range of CTL1 to CTH1, and average value signals of the display area satisfy that Ave_R(n, m)=A>Ave_G(n, m)=B>Ave_B (n, m)=C, in the display area, a B light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not R(i, j)>G(i, j)>B(i, j), because in the display area, Ave_R(n, m)=A>Ave_G(n, m)=B>Ave_B(n, m)=C, and a mainly displayed color is red, R covers most sub-pixels, and a few existing B sub-pixels are not displayed because the B light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 300 to 30, a color saturation value C(n, m) falls within a preset value range of CTL1 to CTH1, and average value signals of the display area satisfy that Ave_R(n, m)=A>Ave_B(n, m)=C>Ave_G (n, m)=B, in the display area, a G light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not R(i, j)>B(i, j)>G(i, j), because in the display area, Ave_R(n, m)=A>Ave_B(n, m)=C>Ave_G(n, m)=B, and a mainly displayed color is red, R covers most sub-pixels, and a few existing G sub-pixels are not displayed because the G light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 30 to 90, a color saturation value C(n, m) falls within a preset value range of CTL2 to CTH2, and average value signals of the display area satisfy that Ave_R(n, m)=A>Ave_G(n, m)=B>Ave_B (n, m)=C, in the display area, a B light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not R(i, j)>G(i, j)>B(i, j), because in the display area, Ave_R(n, m)=A>Ave_G(n, m)=B>Ave_B(n, m)=C, and mainly displayed colors are red and green, R and G cover most sub-pixels, and a few existing B sub-pixels are not displayed because the B light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 90 to 150, a color saturation value C(n, m) falls within a preset value range of CTL3 to CTH3, and average value signals of the display area satisfy that Ave_G(n, m)=B>Ave_R(n, m)=A>Ave_B (n, m)=C, in the display area, a B light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not G(i, j)>R(i, j)>B(i, j), because in the display area, Ave_G(n, m)=B>Ave_R(n, m)=A>Ave_B(n, m)=C, and mainly displayed colors are green and red, G and R cover most sub-pixels, and a few existing B sub-pixels are not displayed because the B light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 150 to 210, a color saturation value C(n, m) falls within a preset value range of CTL4 to CTH4, and average value signals of the display area satisfy that Ave_G(n, m)=B>Ave_R(n, m)=A>Ave_B (n, m)=C, in the display area, a B light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not G(i, j)>R(i, j)>B(i, j), because in the display area, Ave_G(n, m)=B>Ave_R(n, m)=A>Ave_B(n, m)=C, and a mainly displayed color is green, G covers most sub-pixels, and a few existing B sub-pixels are not displayed because the B light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 150 to 210, a color saturation value C(n, m) falls within a preset value range of CTL4 to CTH4, and average value signals of the display area satisfy that Ave_G(n, m)=B>Ave_B(n, m)=C>Ave_R (n, m)=A, in the display area, an R light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not G(i, j)>B(i, j)>R(i, j), because in the display area, Ave_G(n, m)=B>Ave_B(n, m)=C>Ave_R(n, m)=A, and a mainly displayed color is green, G covers most sub-pixels, and a few existing R sub-pixels are not displayed because the R light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 210 to 240, a color saturation value C(n, m) falls within a preset value range of CTL5 to CTH5, and average value signals of the display area satisfy that Ave_G(n, m)=B>Ave_B(n, m)=C>Ave_R (n, m)=A, in the display area, an R light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not G(i, j)>B(i, j)>R(i, j), because in the display area, Ave_G(n, m)=B>Ave_B(n, m)=C>Ave_R(n, m)=A, and mainly displayed colors are green and blue, G and B cover most sub-pixels, and a few existing R sub-pixels are not displayed because the R light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 210 to 240, a color saturation value C(n, m) falls within a preset value range of CTL5 to CTH5, and average value signals of the display area satisfy that Ave_B(n, m)=C>Ave_G(n, m)=B>Ave_R (n, m)=A, in the display area, an R light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not B(i, j)>G(i, j)>R(i, j), because in the display area, Ave_B(n, m)=C>Ave_G(n, m)=B>Ave_R(n, m)=A, and mainly displayed colors are green and blue, G and B cover most sub-pixels, and a few existing R sub-pixels are not displayed because the R light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 240 to 300, a color saturation value C(n, m) falls within a preset value range of CTL6 to CTH6, and average value signals of the display area satisfy that Ave_B(n, m)=C>Ave_G(n, m)=B>Ave_R (n, m)=A, in the display area, an R light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not B(i, j)>G(i, j)>R(i, j), because in the display area, Ave_B(n, m)=C>Ave_G(n, m)=B>Ave_R(n, m)=A, and a mainly displayed color is blue, B covers most sub-pixels, and a few existing R sub-pixels are not displayed because the R light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 240 to 300, a color saturation value C(n, m) falls within a preset value range of CTL6 to CTH6, and average value signals of the display area satisfy that Ave_B(n, m)=C=A>Ave_R(n, m)=A>Ave_G(n, m)=B, in the display area, a G light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not B(i, j)>R(i, j)>G(i, j), because in the display area, Ave_B(n, m)=C>Ave_R(n, m)=A>Ave_G(n, m)=B, and a mainly displayed color is blue, B covers most sub-pixels, and a few existing R sub-pixels are not displayed because the R light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 300 to 330, a color saturation value C(n, m) falls within a preset value range of CTL7 to CTH7, and average value signals of the display area satisfy that Ave_B(n, m)=C=A>Ave_R(n, m)=A>Ave_G(n, m)=B, in the display area, a G light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not B(i, j)>R(i, j)>G(i, j), because in the display area, Ave_B(n, m)=C>Ave_R(n, m)=A, >Ave_G(n, m)=B and mainly displayed colors are blue and red, B and R cover most sub-pixels, and a few existing G sub-pixels are not displayed because the G light source signal is 0, so that overall picture quality is not greatly affected.

In an embodiment, when in a display area (n, m), a hue angle value H(n, m) calculated according to average value signals Ave_R(n, m)=A, Ave_G(n, m)=B, and Ave_B(n, m)=C falls within a hue angle range of 300 to 330, a color saturation value C(n, m) falls within a preset value range of CTL7 to CTH7, and average value signals of the display area satisfy that Ave_R(n, m)=A>Ave_B(n, m)=C>Ave_G (n, m)=B, in the display area, a G light source signal is adjusted to 0 in a time period of displaying a second gray-scale data group. To be specific, a color light source corresponding to a minimum average value in the display area is turned off. In this way, in the time period of displaying the second gray-scale data group, even if a relationship of magnitude of gray-scale values of R(i, j), G(i, j), and B(i, j) sub-pixels existing in another sub-pixel combination in the display area is not R(i, j)>B(i, j)>G(i, j), because in the display area, Ave_R(n, m)=A>Ave_B(n, m)=C>Ave_G(n, m)=B, and mainly displayed colors are red and blue, R and B cover most sub-pixels, and a few existing G sub-pixels are not displayed because the G light source signal is 0, so that overall picture quality is not greatly affected.

In addition, the driving method further includes increasing a driving frequency of the $n^{th}$ pixel unit to 1 to 3 times an original one, to compensate for a display speed reduced by gray-scale value decomposition. One original gray-scale value is decomposed into two gray-scale values to be displayed in two consecutive time periods. Consequently, a display time period of a picture becomes two times an original one. To be specific, a display speed is reduced to a half of an original one. To compensate for the display speed reduced by gray-scale value decomposition, the driving frequency may be increased.

In an embodiment, the driving frequency of the $n^{th}$ pixel unit is increased to 2 times the original one, to maintain a display speed of the pixel unit after the gray-scale value decomposition the same as a display speed of the pixel unit before the gray-scale value decomposition. One original gray-scale value is decomposed into two gray-scale values to be displayed in two consecutive time periods. Consequently, a display time period of a picture becomes two times an original one. To be specific, a display speed is reduced to a half of an original one. To maintain the display speed after the gray-scale value decomposition the same as the display speed before the decomposition, the driving frequency may be increased to 2 times the original one. In this way, a color shift problem of liquid crystal display is alleviated without damaging an original visual effect.

The driving method further includes increasing brightness of a color light source controlled to be in an on state in the backlight unit to 1 to 3 times original brightness, to compensate for brightness reduced by gray-scale value decomposition, an increase of a driving frequency, or a combination of gray-scale value decomposition and an increase of a driving frequency. Because a process of gray-scale value decomposition is decomposing an original high gray-scale value into two new low gray-scale values, that is, in practice, a group of high voltage signals is decomposed into two groups of low voltage signals, brightness is reduced. On the other hand, one original gray-scale value is decomposed into two gray-scale values to be displayed in two consecutive time periods. Consequently, a display time period of a picture becomes two times an original one. To be specific, a display speed is reduced to a half of an original one. To compensate for the display speed reduced by gray-scale value decomposition, the driving frequency may usually be increased. After the driving frequency is increased, brightness is further reduced because an actual time period of displaying of each gray-scale data group at the increased driving frequency is shorter than that at the original driving frequency. For example, if the original driving frequency is increased to two times the original driving frequency, an actual displaying time period of a driving signal is changed to ½ of an original driving signal time period, resulting in reduction in brightness. To compensate for brightness reduced by gray-scale value decomposition, an increase of a driving frequency, or a combination of gray-scale value decomposition and an increase of a driving frequency, backlight brightness may be increased.

In an embodiment, brightness of a color light source controlled to be in an on state in the backlight unit to 2 times original brightness, to maintain brightness of the pixel unit after the gray-scale value decomposition the same as brightness before the gray-scale value decomposition. In this way, to make a display effect after gray-scale value decomposition basically the same as a display effect of the gray-scale data, a color shift problem of liquid crystal display is alleviated without damaging an original visual effect.

In the foregoing driving method for a liquid crystal display device, the display module is divided into a plurality of mutually independent display areas, and the original gray-scale data group is divided, according to the type of the color corresponding to the to-be-displayed original gray-scale data group of the $n^{th}$ pixel unit, into a first gray-scale data group and a second gray-scale data group in accordance with a specified grouping rule; and the first gray-scale data group and the second gray-scale data group are displayed respectively in two consecutive time periods. An average value of the red gray-scale values, an average value of the green gray-scale values, and an average value of the blue gray-scale values in the $N^{th}$ display area are calculated, and a minimum average value among the average value of the red gray-scale values, the average value of the green gray-scale values, and the average value of the blue gray-scale values in the $N^{th}$ display area is determined. In addition, the color saturation value C and the hue angle value H in the LCH color space diagram are calculated according to the average value of the red gray-scale values, the average value of the green gray-scale values, and the average value of the blue gray-scale values in the $N^{th}$ display area. Further, whether the color saturation value C falls within a specified range of a color saturation value of the display area is determined according to a range of the hue angle value H of the $N^{th}$ display area, and if yes, whether a gray-scale value corresponding to the minimum average value in the display area is 0 in a time period of displaying a second gray-scale data group is determined. In this way, a brightness proportion of a dominant hue is increased, so that a color shift situation of a large-viewing angle dominant hue affected by a low-voltage sub-pixel is alleviated. Moreover, not only brightness presentation of a main signal at a large viewing angle is enhanced, but also entire picture quality and displayed brightness can be maintained unchanged by increasing backlight brightness to two times original brightness, and the entire picture quality and displayed brightness can be maintained unchanged by increasing a driving frequency to two times an original driving frequency. In addition, energy can be saved while alleviating a color shift, and additional wiring on a liquid crystal display panel is not needed while guaranteeing color authenticity of graphics and text.

This application provides another driving method for a liquid crystal display device. As shown in FIG. 1, the liquid crystal display device includes a display module 100, a driving circuit 200, and a backlight module 300. The display module 100 includes a plurality of pixel units arranged in an array 110, and the pixel unit 110 includes a red sub-pixel 111, a green sub-pixel 112, and a blue sub-pixel 113. Each time the pixel unit 110 receives a gray-scale value group, the pixel unit 110 generates a color. The gray-scale value group is generated from gray-scale data input into the display device. The gray-scale value group includes a red gray-scale value, a green gray-scale value, and a blue gray-scale value. The color generated by the pixel unit each time is any one type of a unitary color, a binary mixed color, and a trinary mixed color. The backlight module 300 includes a power supply processing unit 310 and a backlight unit 320. The display module 100 is configured to display graphic and text information. The driving circuit 200 is configured to receive, process, and output driving data to control the display module to work normally. The backlight module 300 is configured to process a current and light up the backlight unit 320. The driving circuit 200 includes a gray-scale data decomposition unit 210, a driving frequency adjustment unit 220, and a backlight adjustment unit 230. The gray-scale data decomposition unit 210 is configured to decompose gray-scale data and output a gray-scale value signal. The driving frequency adjustment unit 220 is configured to adjust a driving frequency. The backlight adjustment unit 230 is configured to adjust a color and brightness of a light source of the backlight unit 320. The backlight unit 320 includes a red light source, a green light source, and a blue light source. The display module 100 is divided into at least two mutually independent display areas. The display area corresponds to at least one backlight unit, and the backlight units corresponding to the different display areas are mutually independent. The driving method includes:

calculating an average value of the red gray-scale values, an average value of the green gray-scale values, and an average value of the blue gray-scale values in the $N^{th}$ display area;

determining a minimum average value among the average value of the red gray-scale values, the average value of the green gray-scale values, and the average value of the blue gray-scale values in the $N^{th}$ display area;

calculating a color saturation value C and a hue angle value H in an LCH color space diagram according to the average value of the red gray-scale values, the average value of the green gray-scale values, and the average value of the blue gray-scale values in the $N^{th}$ display area; and determining, according to a range of the hue angle value H of the $N^{th}$ display area, whether the color saturation value C falls within a specified range of a color saturation value of the display area, and if yes, turning off a corresponding color light source in the backlight unit corresponding to the minimum average value in the display area in a time period of displaying the second gray-scale data group, or setting a gray-scale value corresponding to the minimum average value in the display area to 0; otherwise, maintaining a corresponding color light source in the backlight unit corresponding to the minimum average value in the display area on in a time period of displaying the second gray-scale data group, and maintaining a gray-scale value corresponding to the minimum average value in the display area unchanged.

N is an integer greater than or equal to 1.

The color saturation value C ranges from 0 to 100.

The hue angle value H ranges from 0° to 360°.

In an embodiment, the method further includes:

determining a type of a color corresponding to a to-be-displayed original gray-scale data group of the $n^{th}$ pixel unit 110;

dividing, according to the type of the color corresponding to the to-be-displayed original gray-scale data group of the $n^{th}$ pixel unit 110, the original gray-scale data group into a first gray-scale data group and a second gray-scale data group in accordance with a specified grouping rule; and outputting and displaying the first gray-scale data group and the second gray-scale data group respectively in two consecutive time periods.

n is an integer greater than or equal to 1.

In the foregoing driving method for a liquid crystal display device, the display module is divided into a plurality of mutually independent display areas, and at least one backlight unit 320 corresponding to the $N^{th}$ display area is disposed on a backlight plate; the original gray-scale data group is divided, according to the type of the color corresponding to the to-be-displayed original gray-scale data group of the $n^{th}$ pixel unit, into a first gray-scale data group and a second gray-scale data group in accordance with a specified grouping rule; and the first gray-scale data group and the second gray-scale data group are displayed respectively in two consecutive time periods. An average value of the red gray-scale values, an average value of the green gray-scale values, and an average value of the blue gray-scale values in the $N^{th}$ display area are calculated, and a minimum average value among the average value of the red gray-scale values, the average value of the green gray-scale values, and the average value of the blue gray-scale values in the $N^{th}$ display area is determined. In addition, the color saturation value C and the hue angle value H in the LCH color space diagram are calculated according to the average value of the red gray-scale values, the average value of the green gray-scale values, and the average value of the blue gray-scale values in the $N^{th}$ display area. Further, whether the color saturation value C falls within the specified range of the color saturation value of the display area is determined according to the range of the hue angle value H of the $N^{th}$ display area, and whether the light source of the color corresponding to the minimum average value in the display area is turned off in the time period of displaying the second gray-scale data group and whether the gray-scale value corresponding to the minimum average value in the display area is 0 are determined. In this way, a brightness proportion of a dominant hue is increased, so that a color shift situation of a large-viewing angle dominant hue affected by a low-voltage sub-pixel is alleviated. Moreover, not only brightness presentation of a main signal at a large viewing angle is enhanced, but also entire picture quality and displayed brightness can be maintained unchanged by increasing backlight brightness to two times original brightness, and the entire picture quality and displayed brightness can be maintained unchanged by increasing a driving frequency to two times an original driving frequency. In addition, energy can be saved while alleviating a color shift, and additional wiring on a liquid crystal display panel is not needed while guaranteeing color authenticity of graphics and text.

Any foregoing "backlight unit 320" can independently and separately control light emitting situations and light-up and black-out situations of red, green, and blue light sources. For example, a "light emitting unit" of this disclosure may separately adjust brightness, light-up, and black-out of any of red, green, and blue light, and may alternatively control brightness, a mixing proportion, light-up, and black-out of any two and three of red, green, and blue light.

In an embodiment, the backlight unit 320 may be any light emitting unit capable of separately emitting red, green, and blue light. No limitation is imposed herein. For example, the backlight unit in this disclosure may be an RGB LED lamp.

In an embodiment, a plurality of RGB LED lamps is used in the backlight unit 320.

In an embodiment, the driving method further includes increasing a driving frequency of the $n^{th}$ pixel unit to 1 to 3 times an original one, to compensate for a display speed reduced by gray-scale value decomposition. One original gray-scale value is decomposed into two gray-scale values to be displayed in two consecutive time periods. Consequently, a display time period of a picture becomes two times an original one. To be specific, a display speed is reduced to a half of an original one. To compensate for the display speed reduced by gray-scale value decomposition, the driving frequency may be increased.

In an embodiment, the driving frequency of the $n^{th}$ pixel unit is increased to 2 times the original one, to maintain a display speed of the pixel unit after the gray-scale value decomposition the same as a display speed of the pixel unit before the gray-scale value decomposition. One original gray-scale value is decomposed into two gray-scale values to be displayed in two consecutive time periods. Consequently, a display time period of a picture becomes two times an original one. To be specific, a display speed is reduced to a half of an original one. To maintain the display speed after the gray-scale value decomposition the same as the display speed before the decomposition, the driving frequency may be increased to 2 times the original one. In this way, a color shift problem of liquid crystal display is alleviated without damaging an original visual effect.

In an embodiment, the driving method further includes increasing brightness of a color light source controlled to be in an on state in the backlight unit to 1 to 3 times original brightness, to compensate for brightness reduced by gray-scale value decomposition, an increase of a driving frequency, or a combination of gray-scale value decomposition and an increase of a driving frequency. Because a process of gray-scale value decomposition is decomposing an original high gray-scale value into two new low gray-scale values, that is, in practice, a group of high voltage signals is decomposed into two groups of low voltage signals, brightness is reduced. On the other hand, one original gray-scale value is decomposed into two gray-scale values to be displayed in two consecutive time periods. Consequently, a display time period of a picture becomes two times an original one. To be specific, a display speed is reduced to a half of an original one. To compensate for the display speed reduced by gray-scale value decomposition, the driving frequency may usually be increased. After the driving frequency is increased, brightness is further reduced because an actual time period of displaying of each gray-scale data group at the increased driving frequency is shorter than that at the original driving frequency. For example, if the original driving frequency is increased to two times the original driving frequency, an actual displaying time period of a driving signal is changed to ½ of an original driving signal time period, resulting in reduction in brightness. To compensate for brightness reduced by gray-scale value decomposition, an increase of a driving frequency, or a combination of gray-scale value decomposition and an increase of a driving frequency, backlight brightness may be increased.

In an embodiment, brightness of a color light source controlled to be in an on state in the backlight unit to 2 times original brightness, to maintain brightness of the pixel unit after the gray-scale value decomposition the same as brightness before the gray-scale value decomposition. In this way, to make a display effect after gray-scale value decomposition basically the same as a display effect of the gray-scale data, a color shift problem of liquid crystal display is alleviated without damaging an original visual effect.

It should be noted that the sequence numbers of steps involved in a specific solution should not be considered as limiting the order of steps as long as the implementation of this solution is not affected. The steps appearing earlier may be executed earlier than, later than, or at the same time as those appearing later. Such implementations shall all be considered as falling within the protection scope of this application as long as this solution can be implemented.

Technical features in the foregoing embodiments may be combined randomly. For the brevity of description, not all possible combinations of various technical features in the foregoing embodiments are described. However, as long as combinations of these technical features do not contradict each other, it should be considered that the combinations all fall within the scope of this specification.

The foregoing embodiments only show several implementations of this application and are described in detail, but they should not be construed as a limit to the patent scope of this application. It should be noted that, a person of ordinary skill in the art may make various changes and improvements without departing from the ideas of this application, which shall all fall within the protection scope of this application. Therefore, the protection scope of the patent of this application shall be subject to the appended claims.

The invention claimed is:

1. A driving method for a liquid crystal display device, wherein the liquid crystal display device comprises a display module; the display module comprises a plurality of pixel units arranged in an array; each pixel unit comprises a red sub-pixel, a green sub-pixel, and a blue sub-pixel; each pixel unit generates one color each time when receiving one gray-scale value group; the gray-scale value group comprises a red gray-scale value, a green gray-scale value, and a blue gray-scale value; and the display module is divided into at least two mutually independent display areas, wherein the driving method comprises:

calculating an average value of the red gray-scale values, an average value of the green gray-scale values, and an average value of the blue gray-scale values in a $N^{th}$ display area;

determining a minimum average value among the average value of the red gray-scale values, the average value of the green gray-scale values, and the average value of the blue gray-scale values in the $N^{th}$ display area;

calculating a color saturation value C and a hue angle value H in a Lightness-Chroma-Hue (LCH) color space diagram based on the average value of the red gray-scale values, the average value of the green gray-scale values, and the average value of the blue gray-scale values in the $N^{th}$ display area; and when the color saturation value C falls within a specified range of a color saturation value of the display area, based on a range of the hue angle value H of the $N^{th}$ display area, setting a gray-scale value corresponding to the minimum average value in the display area to 0;

when the color saturation value C falls outside of the specified range of a color saturation value of the display area, based on the range of the hue angle value H of the $N^{th}$ display area, maintaining a gray-scale value corresponding to the minimum average value in the display area to be unchanged;

wherein

N is an integer greater than or equal to 1;

the color saturation value C ranges from 0 to 100; and the hue angle value H ranges from 0° to 360°.

2. The driving method for a liquid crystal display device according to claim 1, wherein the color generated by each pixel unit each time is any one type of a unitary color, a binary mixed color, and a trinary mixed color, wherein the driving method further comprises:

determining a type of a color corresponding to a to-be-displayed original gray-scale data group of the $n^{th}$ pixel unit;

dividing, based on the type of the color corresponding to the to-be-displayed original gray-scale data group of the $n^{th}$ pixel unit, the original gray-scale data group into a first gray-scale data group and a second gray-scale data group in accordance with a specified grouping rule; and outputting and displaying the first gray-scale data group and the second gray-scale data group respectively in two consecutive time periods, wherein n is an integer greater than or equal to 1.

3. The driving method for a liquid crystal display device according to claim 2, wherein a method for determining whether a lamp of a color corresponding to the minimum average value in the display area is turned off comprises:

establishing coordinates in the LCH color space diagram, wherein the hue angle value H corresponding to red is 0°, the hue angle value H corresponding to yellow is 90°, the hue angle value H corresponding to green is 180°, and the hue angle value H corresponding to blue is 270°;

dividing the LCH color space diagram into a plurality of hue angle ranges, wherein each hue angle range corresponds to a dominant hue area;

setting a preset value range of the color saturation value C for each hue angle range; and determining a hue angle range to which the hue angle value H belongs, and determining whether the color saturation value C falls within the preset value range corresponding to the hue angle range, and if yes, turning off the lamp of the color corresponding to the minimum average value in the display area in a time period of displaying the second gray-scale data group; otherwise, maintaining the lamp of the color corresponding to the minimum average value in the display area to be turned on in a time period of displaying the second gray-scale data group.

4. The driving method for a liquid crystal display device according to claim 2, wherein the driving method further comprises:

increasing a driving frequency of the $n^{th}$ pixel unit to 1 to 3 times an original one, to compensate for a display speed reduced due to gray-scale value decomposition.

5. The driving method for a liquid crystal display device according to claim 4, wherein the driving method further comprises:

increasing the driving frequency of the $n^{th}$ pixel unit to 2 times the original one, to maintain a display speed of the pixel unit after the gray-scale value decomposition the same as a display speed of the pixel unit before the gray-scale value decomposition.

6. The driving method for a liquid crystal display device according to claim 2, wherein the driving method further comprises:

increasing brightness of a color lamp controlled to be in an ON state to 1 to 3 times original brightness, to compensate for brightness reduced due to gray-scale value decomposition, an increase of a driving frequency, or a combination of gray-scale value decomposition and an increase of a driving frequency.

7. The driving method for a liquid crystal display device according to claim 6, wherein the driving method further comprises:

increasing the brightness of the color lamp controlled to be in an ON state to 2 times the original brightness, to maintain display brightness of the pixel unit after the gray-scale value decomposition the same as display brightness before the gray-scale value decomposition.

8. The driving method for a liquid crystal display device according to claim 1, wherein the determining a type of a color corresponding to a to-be-displayed original gray-scale data group of the $n^{th}$ pixel unit comprises:

determining the type of the color corresponding to the original gray-scale data according to a quantity of pieces of 0-gray-scale data in the to-be-displayed original gray-scale data group of the $n^{th}$ pixel unit:

determining that the color corresponding to the original gray-scale data group is a trinary mixed color when the original gray-scale data group does not comprise 0-gray-scale data;

determining that the color corresponding to the original gray-scale data group is a binary mixed color when the original gray-scale data group comprises only one piece of 0-gray-scale data; and determining that the color corresponding to the original gray-scale data group to be a unitary color when the original gray-scale data group comprises only two pieces of 0-gray-scale data.

9. The driving method for a liquid crystal display device according to claim 8, wherein the grouping rule comprises:

taking minimum original gray-scale data in the original gray-scale data group corresponding to a trinary mixed color pixel unit as common gray-scale data of the red sub-pixel, the green sub-pixel, and the blue sub-pixel in the pixel unit, to constitute the first gray-scale data group; and taking a difference data group obtained by subtracting the first gray-scale data group from the original gray-scale data group corresponding to the trinary mixed color pixel unit as the second gray-scale data group.

10. The driving method for a liquid crystal display device according to claim 8, wherein the grouping rule comprises:

taking minimum non-0-gray-scale data in the original gray-scale data group corresponding to a binary mixed color pixel unit as common gray-scale data of sub-pixels corresponding to two pieces of non-0-gray-scale data in the pixel unit, to constitute, together with 0-gray-scale data, the first gray-scale data group; and taking a difference data group obtained by subtracting the first gray-scale data group from the original gray-scale data group corresponding to the binary mixed color pixel unit as the second gray-scale data group of the pixel unit.

11. The driving method for a liquid crystal display device according to claim 8, wherein the grouping rule comprises:

taking gray-scale data corresponding to half of a gray-scale value corresponding to non-0-gray-scale data in the original gray-scale data group corresponding to a unitary color pixel unit as gray-scale data of a sub-pixel corresponding to non-0-gray-scale data in the pixel unit, to constitute, together with 0-gray-scale data, the first gray-scale data group and the second gray-scale data group respectively.

12. A driving method for a liquid crystal display device, wherein the liquid crystal display device comprises a display module, a driving circuit and a backlight module; the display module comprises a plurality of pixel units arranged in an array, each pixel unit comprises a red sub-pixel, a green sub-pixel, and a blue sub-pixel; a color generated by each pixel unit each time is any one type of a unitary color, a binary mixed color, and a trinary mixed color; the backlight module is provided with a plurality of backlight units; the backlight unit comprises a red light source, a green light source, and a blue light source; the display module is divided into at least two mutually independent display areas; and the display area corresponds to at least one backlight unit, and the backlight units corresponding to different display areas are mutually independent, wherein the driving method comprises: calculating an average value of the red gray-scale values, an average value of the green gray-scale values, and an average value of the blue gray-scale values in a $N^{th}$ display area; determining a minimum average value among the average value of the red gray-scale values, the average value of the green gray-scale values, and the average value of the blue gray-scale values in the $N^{th}$ display area; calculating a color saturation value C and a hue angle value H in a Lightness-Chroma-Hue (LCH) color space diagram according to the average value of the red gray-scale values, the average value of the green gray-scale values, and the average value of the blue gray-scale values in the $N^{th}$ display area; and when the color saturation value C falls within a specified range of a color saturation value of the display area, based on a range to which the hue angle value H of the $N^{th}$ display area belongs, turning off a corresponding color light source in the backlight unit corresponding to the minimum average value in the display area, or setting a gray-scale value corresponding to the minimum average value in the display area to 0; when the color saturation value C falls outside of the specified range of a color saturation value of the display area, based on the range to which the hue angle value H of the $N^{th}$ display area belongs, maintaining a corresponding color light source in the backlight unit corresponding to the minimum average value in the display area to be turned on, and maintaining a gray-scale value corresponding to the minimum average value in the display area to be unchanged; wherein N is an integer greater than or equal to 1; the color saturation value C ranges from 0 to 100; and the hue angle value H ranges from 0° to 360°.

13. The driving method for a liquid crystal display device according to claim 12, wherein the driving method further comprises:

determining a type of a color corresponding to a to-be-displayed original gray-scale data group of the $n^{th}$ pixel unit;

dividing, based on the type of the color corresponding to the to-be-displayed original gray-scale data group of the $n^{th}$ pixel unit, the original gray-scale data group into a first gray-scale data group and a second gray-scale data group in accordance with a specified grouping rule; and outputting and displaying the first gray-scale data group and the second gray-scale data group respectively in two consecutive time periods, wherein n is an integer greater than or equal to 1.

14. The driving method for a liquid crystal display device according to claim 13, wherein the determining a type of a color corresponding to a to-be-displayed original gray-scale data group of the $n^{th}$ pixel unit comprises:

determining the type of the color corresponding to the original gray-scale data according to a quantity of pieces of 0-gray-scale data in the to-be-displayed original gray-scale data group of the $n^{th}$ pixel unit;

determining that the color corresponding to the original gray-scale data group is a trinary mixed color when the original gray-scale data group does not comprise 0-gray-scale data;

determining that the color corresponding to the original gray-scale data group is a binary mixed color when the original gray-scale data group comprises only one piece of 0-gray-scale data; and determining that the color corresponding to the original gray-scale data group to be a unitary color when the original gray-scale data group comprises only two pieces of 0-gray-scale data.

15. The driving method for a liquid crystal display device according to claim 14, wherein the driving method further comprises:

increasing brightness of a color lamp controlled to be in an on state to 1 to 3 times original brightness, to compensate for brightness reduced due to gray-scale value decomposition, an increase of a driving frequency, or a combination of gray-scale value decomposition and an increase of a driving frequency.

16. The driving method for a liquid crystal display device according to claim 13, wherein the grouping rule comprises:

taking minimum original gray-scale data in the original gray-scale data group corresponding to a trinary mixed color pixel unit as common gray-scale data of the red sub-pixel, the green sub-pixel, and the blue sub-pixel in the pixel unit, to constitute the first gray-scale data group; and taking a difference data group obtained by subtracting the first gray-scale data group from the original gray-scale data group corresponding to the trinary mixed color pixel unit as the second gray-scale data group.

17. The driving method for a liquid crystal display device according to claim 13, wherein the grouping rule comprises:

taking minimum non-0-gray-scale data in the original gray-scale data group corresponding to a binary mixed color pixel unit as common gray-scale data of sub-pixels corresponding to two pieces of non-0-gray-scale data in the pixel unit, to constitute, together with 0-gray-scale data, the first gray-scale data group; and taking a difference data group obtained by subtracting the first gray-scale data group from the original gray-scale data group corresponding to the binary mixed color pixel unit as the second gray-scale data group of the pixel unit.

18. The driving method for a liquid crystal display device according to claim 13, wherein the grouping rule comprises:

taking gray-scale data corresponding to half of a gray-scale value corresponding to non-0-gray-scale data in an original gray-scale data group corresponding to a unitary color pixel unit as gray-scale data of a sub-pixel corresponding to non-0-gray-scale data in the pixel unit, to constitute, together with 0-gray-scale data, the first gray-scale data group and the second gray-scale data group respectively.

19. The driving method for a liquid crystal display device according to claim 13, wherein a method for determining whether a lamp of a color corresponding to the minimum average value in the display area is turned off comprises:

establishing coordinates in the LCH color space diagram, wherein the hue angle value H corresponding to red is 0°, the hue angle value H corresponding to yellow is 90°, the hue angle value H corresponding to green is 180°, and the hue angle value H corresponding to blue is 270°;

dividing the LCH color space diagram into a plurality of hue angle ranges, wherein each hue angle range corresponds to a dominant hue area;

setting a preset value range of the color saturation value C in each hue angle range; and determining a hue angle range to which the hue angle value H belongs, and determining whether the color saturation value C falls within the preset value range corresponding to the hue angle range, and if yes, turning off the lamp of the color corresponding to the minimum average value in the display area in a time period of displaying the second gray-scale data group; otherwise, maintaining the lamp of the color corresponding to the minimum average value in the display area to be turned on in a time period of displaying the second gray-scale data group.

20. The driving method for a liquid crystal display device according to claim 19, wherein the driving method further comprises:

increasing a driving frequency of the $n^{th}$ pixel unit to 1 to 3 times an original one, to compensate for a display speed reduced due to gray-scale value decomposition.

* * * * *